US011141847B2

(12) United States Patent
Wang

(10) Patent No.: US 11,141,847 B2
(45) Date of Patent: Oct. 12, 2021

(54) MULTIFUNCTIONAL STAPLER

(71) Applicants: HANGZHOU GREAT STAR INDUSTRIAL CO., LTD., Hangzhou (CN); HANGZHOU GREAT STAR TOOLS CO., LTD., Hangzhou (CN)

(72) Inventor: Weiyi Wang, Hangzhou (CN)

(73) Assignees: HANGZHOU GREAT STAR INDUSTRIAL CO., LTD., Hangzhou (CN); HANGZHOU GREAT STAR TOOLS CO., LTD.

( * ) Notice: Subject to any disclaimer, the term of this patent is extended or adjusted under 35 U.S.C. 154(b) by 217 days.

(21) Appl. No.: 16/470,785

(22) PCT Filed: Sep. 29, 2017

(86) PCT No.: PCT/CN2017/104560

§ 371 (c)(1),
(2) Date: Jun. 18, 2019

(87) PCT Pub. No.: WO2019/061344

PCT Pub. Date: Apr. 4, 2019

(65) Prior Publication Data

US 2019/0337134 A1 Nov. 7, 2019

(51) Int. Cl.
*B25C 5/11* (2006.01)
*B25C 5/16* (2006.01)

(52) U.S. Cl.
CPC ..... *B25C 5/11* (2013.01); *B25C 5/162* (2013.01); *B25C 5/1606* (2013.01); *B25C 5/1641* (2013.01)

(58) Field of Classification Search
CPC ..... B25C 5/11; B25C 5/1641–1662; B25C 5/1665; B25C 5/1606; B25C 5/162; B25C 5/0285; B25C 5/06; B25C 1/02
See application file for complete search history.

(56) References Cited

U.S. PATENT DOCUMENTS 3,862,712 A * 1/1975 LaPointe ..... B25C 5/10 227/127
9,481,078 B2 11/2016 Maltais et al.
(Continued)

FOREIGN PATENT DOCUMENTS

| | | | |
|---|---|---|---|
| CN | 101439509 | B | 3/2011 |
| CN | 102133747 | A | 7/2011 |
| CN | 203438186 | U | 2/2014 |
| CN | 103770077 | A | 5/2014 |
| CN | 104339319 | A | 2/2015 |

(Continued)

OTHER PUBLICATIONS

International Search Report including English translation for International Application No. PCT/CN2017/104560 dated Jul. 5, 2018.

*Primary Examiner* — Joshua G Kotis
(74) *Attorney, Agent, or Firm* — Sage Patent Group

(57) ABSTRACT

The present invention provides a multifunctional stapler including a housing, a nailing portion arranged at a front end of the housing, and a toggling device, a part of which being arranged inside the housing and a part of which extending to the outside of the housing. The nailing portion comprises: a staple feeding member arranged at a front end of the bottom of the housing, a staple feeding groove arranged on the surface at one side of the staple feeding member for receiving staples, a striking member, a part of which being inserted into the staple feeding groove, the toggling device controlling the striking member to strike the staples, and an adjusting device, a part of which being arranged outside the housing, for adjusting a depth of the staple feeding groove.

16 Claims, 10 Drawing Sheets

(56) References Cited

U.S. PATENT DOCUMENTS

| | | | | |
|---|---|---|---|---|
| 2004/0164120 | A1 | 8/2004 | Boswinkel et al. | |
| 2007/0199969 | A1* | 8/2007 | Pozzato | B25C 5/1658 227/8 |
| 2009/0127312 | A1* | 5/2009 | Tsai | B25C 5/06 227/129 |
| 2011/0180583 | A1* | 7/2011 | Wang | B25C 5/1644 227/109 |
| 2012/0043366 | A1* | 2/2012 | Wang | B25C 5/1637 227/139 |
| 2012/0111916 | A1* | 5/2012 | Chen | B25C 5/06 227/110 |
| 2013/0221055 | A1* | 8/2013 | Huang | B25C 5/1617 227/109 |
| 2013/0221056 | A1* | 8/2013 | Chen | B25C 5/1658 227/120 |
| 2014/0231486 | A1* | 8/2014 | Burch | B25C 5/0285 227/63 |
| 2015/0041516 | A1* | 2/2015 | Chen | B25C 5/11 227/107 |
| 2015/0273675 | A1* | 10/2015 | Ebbesson | B25C 5/11 227/146 |

FOREIGN PATENT DOCUMENTS

| | | | | |
|---|---|---|---|---|
| DE | 202010000014 | U1 * | 8/2010 | B25C 5/06 |
| WO | WO 2005/102613 | A1 | 11/2005 | |
| WO | WO-2013021224 | A1 * | 2/2013 | B25C 5/1648 |

* cited by examiner

MULTIFUNCTIONAL STAPLER

FIELD OF THE INVENTION

The present invention relates to a hand tool, and in particular, to a multifunctional stapler.

DESCRIPTION OF THE PRIOR ART

The PCT patent WO 2005/102613A1, entitled "Stapler With Adapter", discloses a stapler suitable for four specifications of staples (a T-shaped staple, a U-shaped staple, a barbed staple, a '-'-shaped staple), which controls a sliding member to move up and down, while driving an adjusting member to contact staples selectively, so as to achieve the purpose that the stapler can be applied to staples of different thicknesses. It has the disadvantages that the sliding member in this design solution has to be firstly manipulated to slide up and down, and then a positioning member on the sliding member is operated to implement positioning, so that this stapler needs two operations to achieve the positioning effects, making it inconvenient for a user to operate. Meanwhile, this design solution also has the problem of an over-complicated structure, in that the positioning structure of the sliding member is too complicated, and the production costs of processing and assembling are relatively high.

The Chinese patent 101439509B, entitled "Stapler Suitable For Various Staples", discloses a stapler suitable for various staple specifications, which may rapidly adjust a distance between an adjusting member and a staple box, such that staples of different thicknesses can be secured in the staple box. It has the disadvantages that there is only such a structure for adjusting the distance between the adjusting member and the staple box that the stapler may be suitable for the staples with different widths (or thicknesses), but not provided with a solution for adjusting a strike force of a striking member, so that regardless of a thickness of an object to be stapled, the striking member strikes the staples with the same strike force. Once the object to be stapled is relatively thick, the staples cannot penetrate through all the objects to be stapled, which may affect the stapling effects. Meanwhile, a runner structure is required in this design solution, the requirement for the processing and assembling accuracy is high, and the production cost is relatively high.

A new multifunctional stapler is commercially desired, which is suitable for use with staples of different specifications and widths, and is capable of adjusting the strike force so as to better achieve puncture effects.

SUMMARY OF THE INVENTION

An objective of the present invention is to provide a multifunctional stapler which solves the problems existing in the prior art of poor stapling effects, complicate structures, relatively high production costs and inconvenient operations.

In order to solve the above technical problems, the present invention provides a multifunctional stapler, including a housing; a nailing portion arranged at a front end of the housing; and a toggling device, a part of which being arranged inside the housing, and a part of which extending to the outside of the housing; the nailing portion includes: a staple feeding member, arranged at a front end of the bottom of the housing; a staple feeding groove arranged on the surface at one side of the staple feeding member, for receiving staples; a striking member, a part of which being inserted into the staple feeding groove, the toggling device controlling the striking member to strike the staples; and an adjusting device, a part of which being arranged outside the housing, for adjusting a depth of the staple feeding groove.

Further, the housing includes a first through hole penetrating through a front wall of the housing; a second through hole penetrating through a top wall of the housing; a third through hole penetrating through a side wall at the upper part of the housing; a first slide groove, for receiving the striking member which is slidable inside the first slide groove for striking member; and a second slide groove for receiving a second adjusting member.

Further, the staple feeding member further includes a fourth through hole, penetrating through a wall of the staple feeding groove; the adjusting device includes a first adjusting member, at one side of which a lug of the first adjusting member being provided and inserted into the fourth through hole of the staple feeding member, at another side of which a stepped groove being provided; the second adjusting member sliding in the second slide groove of the housing; a first push button penetrating through the first through hole of the housing, a part of which protruding outside the housing, another part of which being connected to the second adjusting member; and a press plate, one end of which being connected to the first push button and/or the second adjusting member, the other end of which being inserted into the stepped groove and being contacting with the surface of the stepped groove.

Further, the bottom surface of the stepped groove includes a first stepped surface; a second stepped surface; and an inclined surface connecting the first stepped surface with the second stepped surface.

Further, the first through hole of the housing includes a first position and a second position. When the first push button is located at the first position, the press plate is contacting with the first stepped surface; a distance of the front end of the lug of the first adjusting member inserted into the third through hole of the staple feeding member is less than or equal to a depth of the third through hole of the staple feeding member; when the first push button is located at the second position, the press plate is contacting with the second stepped surface; the front end of the lug of the first adjusting member protrudes from the bottom surface of the staple feeding groove.

Further, the striking member includes a driven plate; and a striking plate, one end of which being fixed to the driven plate, the other end of which being inserted into the staple feeding groove.

Further, the driven plate includes a first body; a fifth through hole of the driven plate, penetrating through the first body; and a sixth through hole of the driven plate, penetrating through the first body.

The toggling device includes a resilient plate, one end of which being fixed to the housing, and the other end of which being inserted into the sixth through hole of the driven plate; a second push button passing through the second through hole of the housing, one part of which protruding outside the housing, and another part of which contacting with one side surface of the resilient plate; and an elastic gasket fixed to the housing and contacting with another side surface of the resilient plate.

Further, the second through hole of the housing includes a third position and a fourth position; among at least one of contacting points between the second push button and the resilient plate, one point of tangency closest to the striking member is a fulcrum for the deformation of the resilient plate; the distance between the fulcrum and the striking member when the second push button is located at the third position is greater than the distance between the fulcrum and the striking member when the second push button is located at the fourth position.

Further, the second push button includes a toggle base, at least one arc protrusion is arranged on the surface of the toggle base facing towards the resilient plate and contacting with the one side surface of the resilient plate; and a toggle block connected to the toggle base and passing through the second through hole of the housing, protruding outside the housing.

Further, the contacting point between the second push button and the resilient plate is adjacent to the middle part of the resilient plate; the contacting point between the elastic gasket and the resilient plate is adjacent to the front end of the resilient plate.

Further, the toggling device includes a first axle, two ends of which being perpendicularly connected to the inner side of two opposite side walls of the housing respectively; a second axle, two ends of which being perpendicularly connected to the inner side of two opposite side walls of the housing, the second axle being parallel to the first axle; a toggling member, which rotates around the first axle and/or the second axle after being stressed; a first elastic member, one end of which being connected to the housing, the other end of which being connected to the top of the toggling member; a joint between the first elastic member and the toggling member being adjacent to the front end of the housing.

Further, the toggling member includes a second body; a protruding portion of the toggling member, arranged at a front end of the second body, and inserted into the fifth through hole of the driven plate; a first fixture slot of the toggling member arranged at the bottom of the toggling member body, and tangent to the surface of the first axle; and a hole of the toggling member arranged in the middle of the second body, provided around the outside of the second axle.

Further, the toggling member further includes a second fixture slot, arranged in the middle of the second body of the toggling member; the multifunctional stapler further includes a barbed steel wire arranged cross the top of the housing, the two ends of which being hinged to the outer side of the two housing plates of the housing respectively; the steel wire being clamped to the second fixture slot of the toggling member.

Further, the multifunctional stapler further includes a third slide groove arranged at the bottom of the housing, one end of which corresponding to the staple feeding groove; and the staple containing portion slidably mounted to the third slide groove, for putting and fixing the staples in and to the staple feeding groove.

Further, two opposite inner side walls of the third slide groove are provided with linear recesses respectively; the staple containing portion includes a base of the staple containing portion; two or more parallel first ribs, fixed to the top surface of the base of the staple containing portion; the front end of the first ribs being arranged opposite to a notch of the staple feeding groove; and a linear convex rib protruding from outer surface of two side walls of the base of the staple containing portion and inserted into the linear recesses.

Further, the staple containing portion further includes a pushing block, slidably mounted to the outside of the first ribs; and a second elastic member, one end of which is fixed to the pushing block, and the other end of which is fixed to a rear end of the base of the staple containing portion.

Further, the multifunctional stapler includes a slot arranged at the bottom of the third slide groove the staple containing portion further includes an elastic key arranged at the top portion of the rear end of the base of the staple containing portion; a fixture block arranged at the top portion of the rear end of the base of the staple containing portion and clamped to the slot; when the elastic key is pressed down, the fixture block is disengaged from the slot.

Further, the housing includes a holding hole, penetrating through the middle portion of the housing; and/or a clamp hook fixed to the surface of the housing; and the staples used in the stapler are T-shaped staples, U-shaped staples, barbed staples or '-'-shaped staples.

The present invention provides a multifunctional stapler, capable of adjusting a depth of the staple feeding groove, such that the staples with different widths may be stably positioned in the staple feeding groove, thus being struck out, so as to realize stapling effects. The present invention may further adjust the strike force according to the thickness of the object to be stapled, thereby realizing better striking effects. The multifunctional stapler according to the present invention has a simple structure, a relatively low production cost, convenient operations, and a wide application range, can be used for striking staples of various specifications and shapes, such as T-shaped staples, '-'-shaped staples, U-shaped staples, or barbed staples with different widths and heights.

REFERENCE NUMERALS

Figure 1:
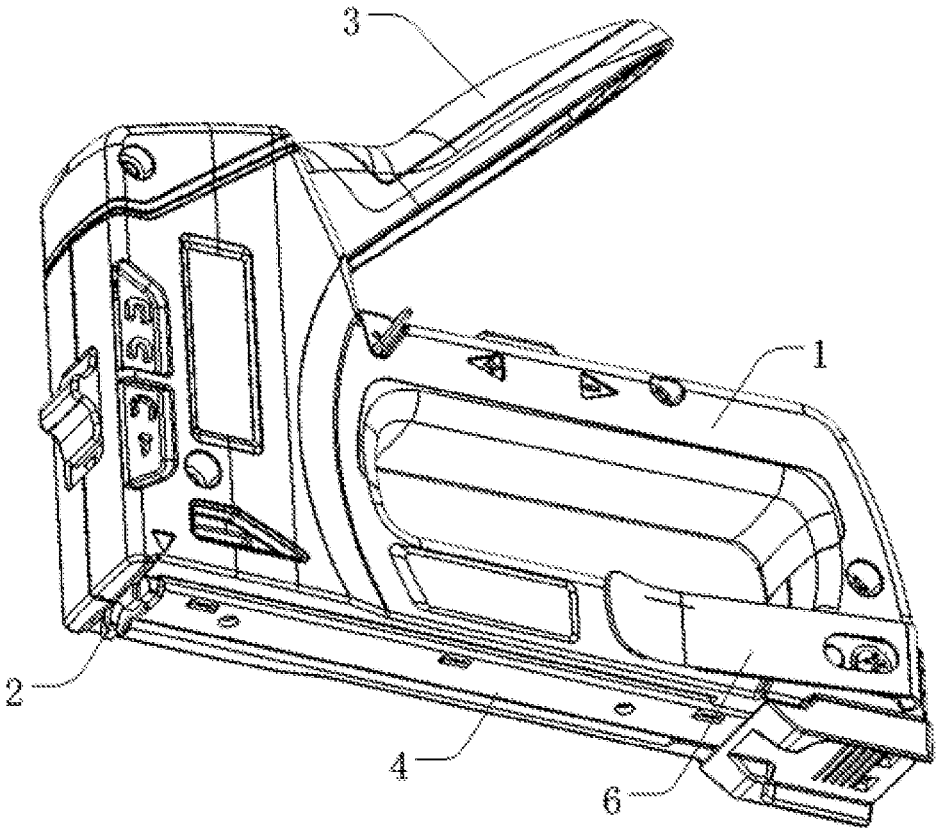
FIG. 1 is an overall structural schematic diagram according to an embodiment of the present invention.

1 housing, 2 nailing portion, 3 toggling device, 4 staple containing portion, 5 staple group, 6 clamp hook;
10 cavity, 11 first housing plate, 12 second housing plate, 13 first through hole, 14 second through hole;
15 third through hole, 16 first slide groove, 17 second slide groove, 18 third slide groove, 19 holding hole;
21 staple feeding member, 22 striking member, 23 adjusting device;
31 resilient plate, 32 second push button, 33 elastic gasket;
34 first axle, 35 second axle, 36 toggling member, 37 first elastic member, 38 steel wire;
41 base of the staple containing portion, 42 first rib, 43 second rib, 44 linear convex rib;
45 pushing block, 46 second elastic member, 47 elastic press key, 48 fixture block, 49 slit;
51 T-shaped staple, 52 U-shaped staple, 53 barbed staple;
131 first position, 132 second position; 141 third position, 142 fourth position; 181 linear recess
211 staple feeding groove, 212 fourth through hole of the staple feeding member; 221 driven plate, 222 striking plate;
231 first adjusting member, 232 second adjusting member, 233 first push button, 234 press plate;
321 push button base, 322 push button block;
361 toggling member body, 362 protruding portion of the toggling member, 363 first fixture slot of the toggling member, 364 waist-type hole of the toggling member;
365 second fixture slot, 366 handheld portion;
2211 driven plate body, 2212 fifth through hole of the driven plate, 2213 sixth through hole of the driven plate;
2311 first adjusting member body, 2312 lug of the adjusting member, 2313 stepped groove;
2314 first stepped surface, 2315 second stepped surface, 2316 smooth inclined surface.

DETAILED DESCRIPTION OF THE PREFERRED EMBODIMENTS

The present invention will be described more fully for those skilled in the art hereinafter with reference to the accompanying drawings by introducing one of the preferable embodiments of the present invention, for the purpose of clarity and better understanding of the techniques. This invention may be embodied in various different forms and the invention should not be construed as being limited to the embodiments set forth herein.

In the accompanying drawings elements with identical structure are marked with the same reference numerals, and like elements with similar structure or function are marked throughout with like reference numerals, respectively. The dimension and thickness of each of the elements in the accompanying drawings are arbitrarily shown, and the invention does not define the dimension and thickness of each element. Certain elements may be shown somewhat exaggerated in thickness in the interest of clarity.

Directional relative terms mentioned in the present invention, such as "upper" "lower", "front", "back", "left", "right", "inside", "outside", "side" and the like, are only directions by referring to the accompanying drawings, and are merely used to explain and describe the present invention, but the present invention is not limited thereto.

It will be understood that when an element is referred to as being "on/above" another element, it can be directly on the other element, or there may be an intermediate element on which it is placed, and the intermediate element is placed on the other element. When an element is referred to as being "mounted to" or "connected to" another element, the two elements can be understood as being directly "mounted" or "connected", or one element via an intermediate element to be indirectly "mounted to" or "connected to" the other element.

As shown in FIGS. 1-6, the present embodiment provides a multifunctional stapler, including a housing 1, a nailing portion 2, a toggling device 3 and a staple containing portion 4. The nailing portion 2 is arranged at the front end of the housing 1; the toggling device 3 is partially arranged in the housing 1, and a part thereof extends to the outside of the housing 1; the staple containing portion 4 is arranged at the bottom of the housing 1. The staple containing portion 4 is used for supplying staples to the nailing portion 2, and the toggling device 3 controls the nailing portion 2 to strike the staples, such that the staple is struck out, so as to realize the stapling effect. In the present embodiment, the position where the nailing portion 2 is located is defined as the front end, and the position where the staple containing portion 4 is located is defined as the bottom.

Figure 2:
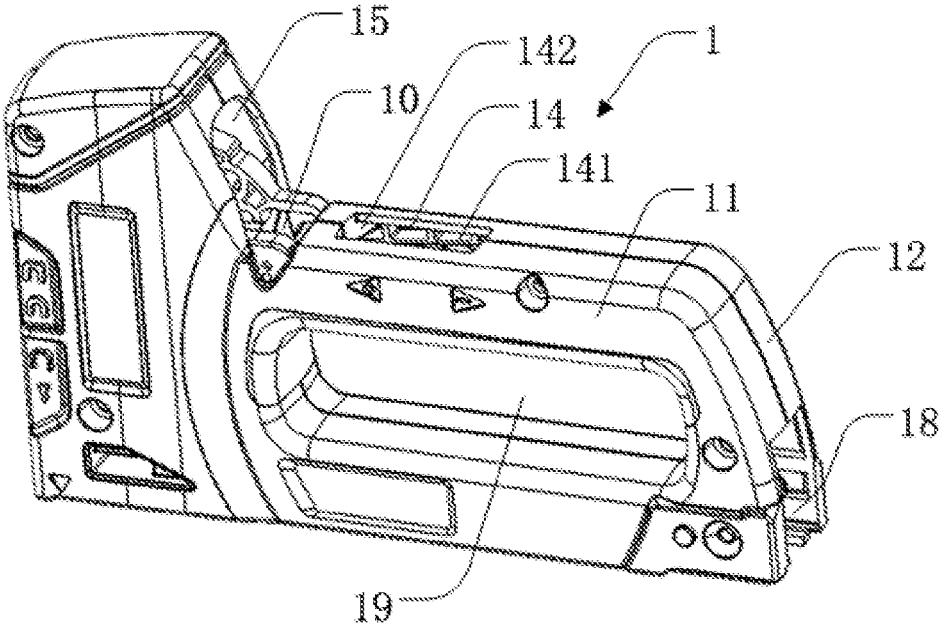
FIG. 2 is a structural schematic diagram of a housing according to the embodiment of the present invention when viewed from an angle.
Figure 3:
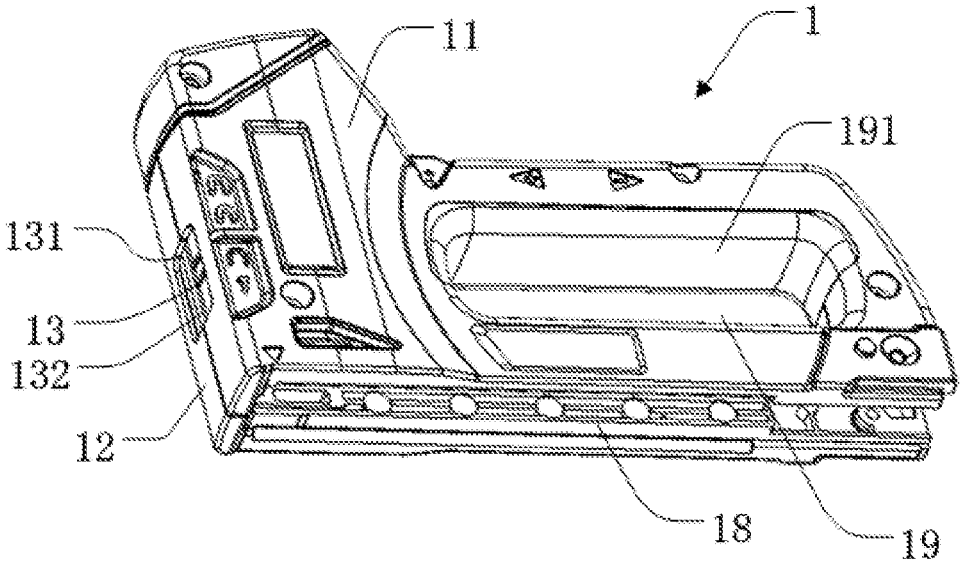
FIG. 3 is structural schematic diagram of the housing according to the embodiment of the present invention when viewed from another angle.

As shown in FIGS. 2-3, the housing 1 includes first and second housing plates 11, 12 arranged opposite to each other. One cavity 10 is enclosed by the two housing plates 11, 12 and a holding hole gasket 191. The housing 1 further includes a first through hole 13 for first push button 233, penetrating through the side wall of the front end of the housing 1; a second through hole 14 for second push button 32, penetrating through the top wall of the housing 1; and a third through hole 15, penetrating through the side wall of the upper portion of the housing 1.

As shown in FIGS. 4-8, the nailing portion 2 includes a staple feeding member 21, a striking member 22 and an adjusting device 23.

The staple feeding member 21 is arranged at the front end of the bottom of the housing 1; the staple feeding groove 211 is arranged on the surface at one side of the staple feeding member 21, for receiving the staples of various specifications and various widths. The staple feeding member 21 further includes a fourth through hole 212 of the staple feeding member 21, penetrating through the bottom surface of the staple feeding groove 211. The staple feeding member 21 is arranged vertically, and a notch of the staple feeding groove 211 faces towards the staple containing portion 4.

Figure 4:
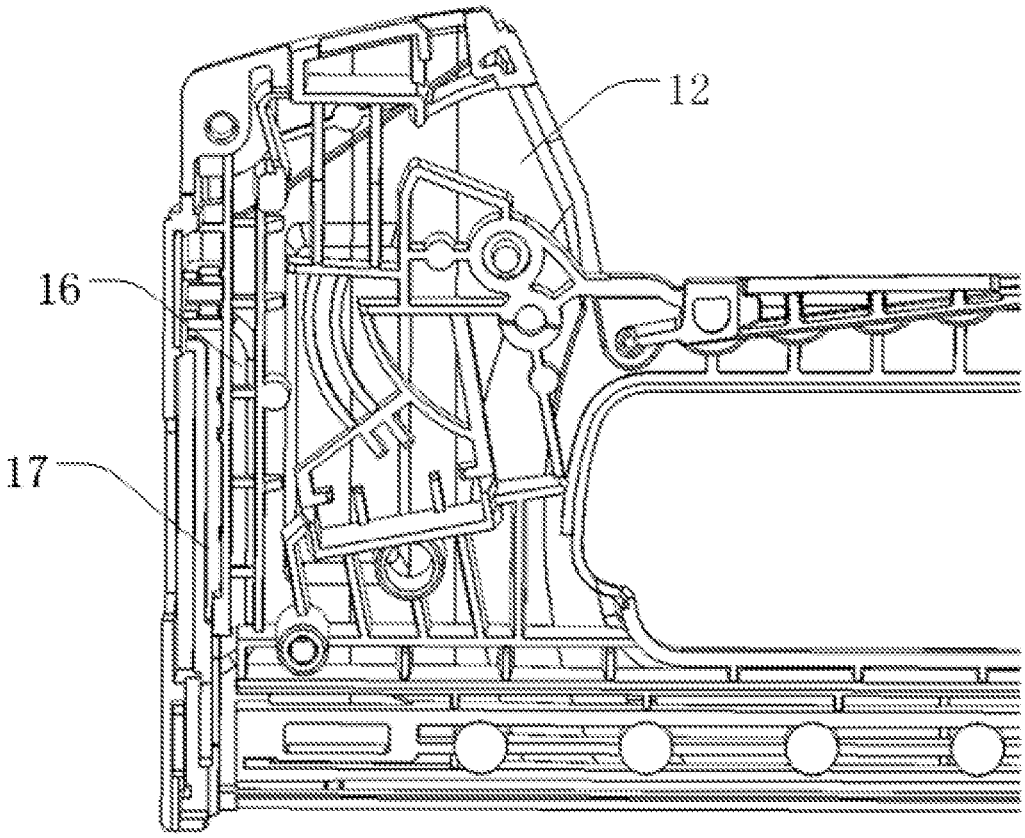
FIG. 4 is a partial structural schematic diagram of a second housing plate according to the embodiment of the present invention.
Figure 5:
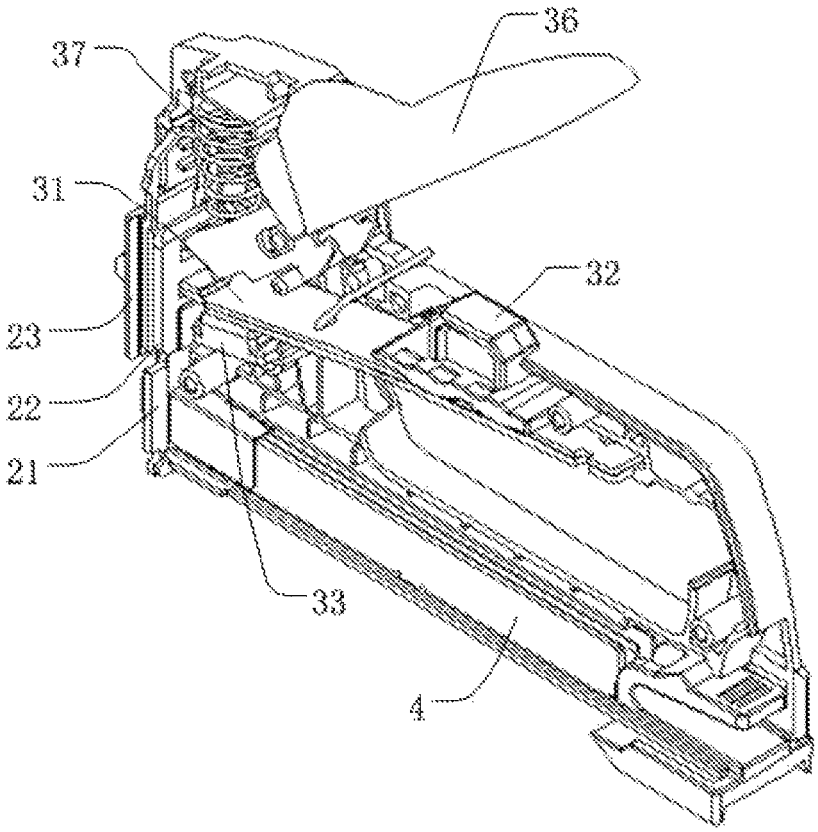
FIG. 5 is a structural schematic diagram with the first housing removed according to the embodiment of the present invention when viewed from an angle.

As shown in FIG. 4, the housing 1 further includes a first slide groove 16 for the striking member 22, which is linear and is vertically arranged in FIG. 4, for receiving the striking member 22.

As shown in FIGS. 4-9, the striking member 22 is controlled by the toggling device 3, and is slidable up and down in the first slide groove 16. A part of the striking member 22 is inserted into the upper part of the staple feeding groove 211, for striking staples.

Figure 10:
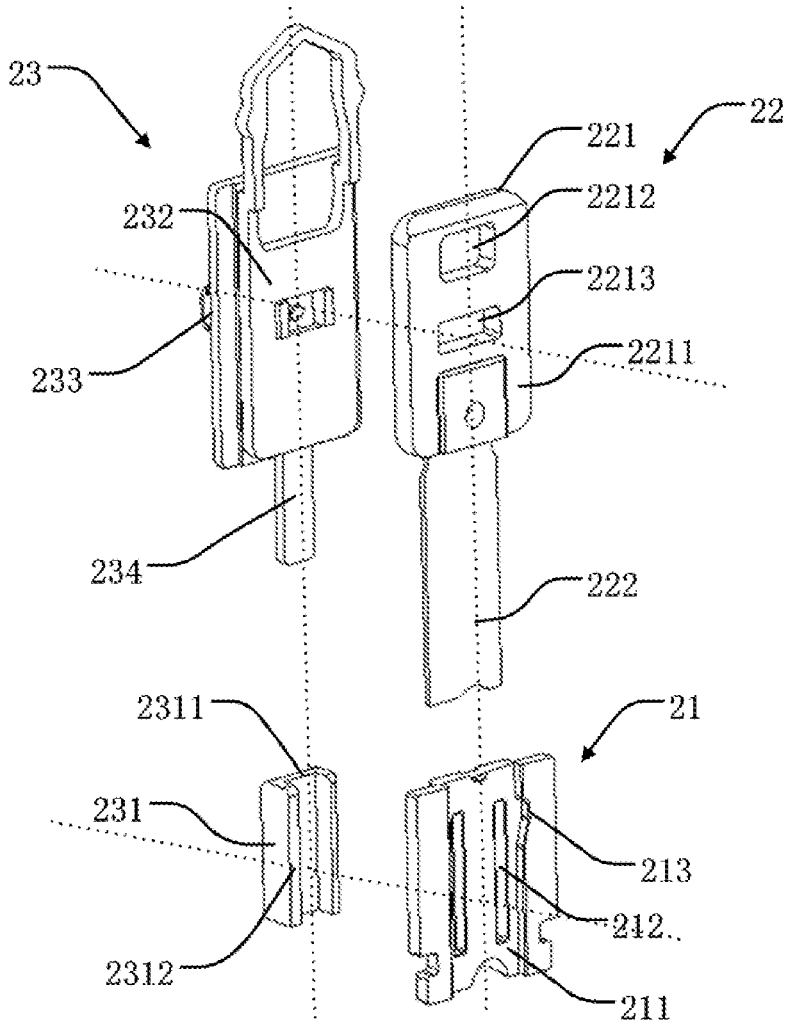
FIG. 10 is an exploded structural schematic diagram of a nailing portion according to the embodiment of the present invention.

As shown in FIG. 10, the striking member 22 includes a driven plate 221 and a striking plate 222. The driven plate 221 includes a driven plate body 2211, a fifth through hole 2212 of the driven plate 221 and a sixth through hole 2213 of the driven plate 221. The fifth through hole 2212 of the driven plate 221 penetrates through the driven plate body 2211, and the sixth through hole 2213 of the driven plate 221 penetrates through the driven plate body 2211. One end of the striking plate 222 is fixed to the driven plate 221, and the other end thereof is inserted into the staple feeding groove 221. The driven plate 221 and the striking plate 222 can also be arranged as an integrated structure. When the toggling device 3 is toggled, the striking member 22 is moved upwards, the striking plate 222 departs from the staple feeding groove 221, the notch of the staple feeding groove 211 towards the staple containing portion 4 is arranged opposite to the front end of the staple containing portion 4, and the staple containing portion 4 pushes the staples into the staple feeding groove 211 from this notch, such that the staple is positioned in the staple feeding groove 211.

As shown in FIG. 10, the adjusting device 23 is partially arranged outside the housing 1, for adjusting the depth of the staple feeding groove 211. The adjusting device 23 includes a first adjusting member 231, a second adjusting member 232, a first push button 233 and a press plate 234.

Figure 11:
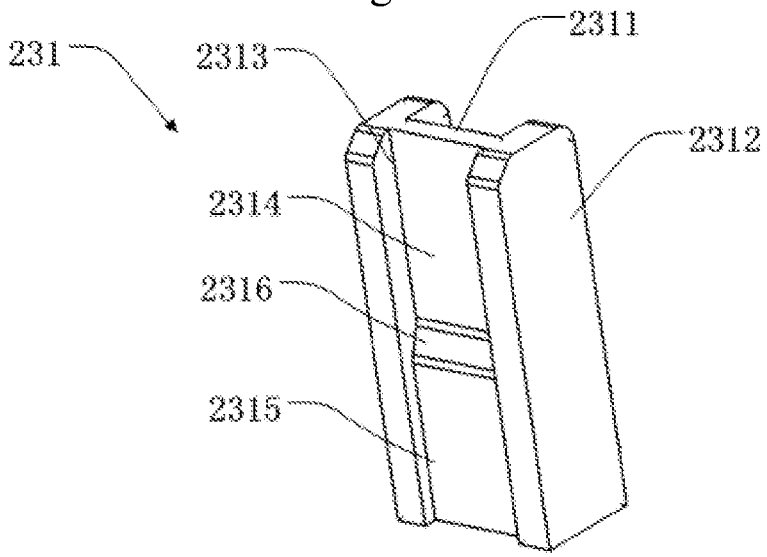
FIG. 11 is a structural schematic diagram of a first adjusting member according to the embodiment of the present invention.

As shown in FIG. 11, the first adjusting member 231 includes a first adjusting member body 2311, a lug of the adjusting member 2312 and a stepped groove 2313. The lug of the adjusting member 2312 is arranged at one side of the adjusting member body 2311, and is inserted into the fourth through hole 212 of the staple feeding member 21. The stepped groove 2313 is arranged at the other side of the adjusting member body 231. The bottom surface of the stepped groove 2313 includes a first stepped surface 2314, a second stepped surface 2315 and a smooth inclined surface 2316 for connecting the first stepped surface 2314 and the second stepped surface 2315. The depth of the first stepped surface 2314 from the opening of the stepped groove 2313 is greater than that of the second surface 2315.

As shown in FIG. 4, the housing 1 further includes a second slide groove 17 for the adjusting member, which is linear and is arranged vertically in FIG. 4, for receiving the second adjusting member 232.

Figure 8:
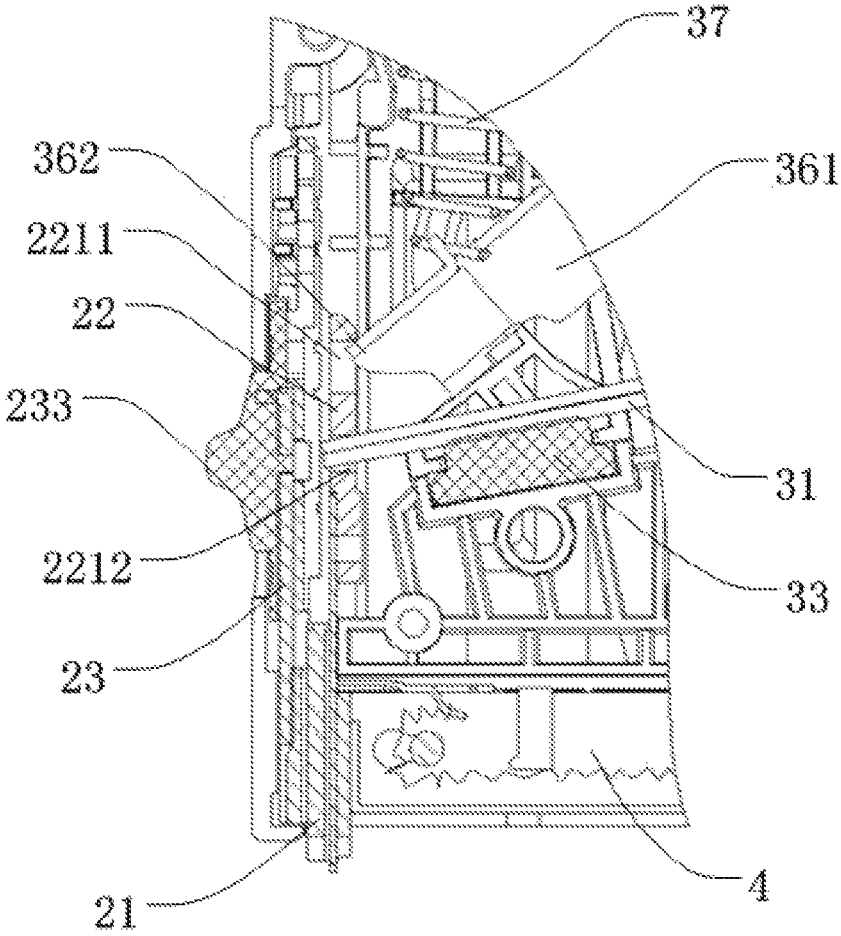
FIG. 8 is an enlarged schematic diagram of a partial structure according to the embodiment of the present invention.
Figure 9:
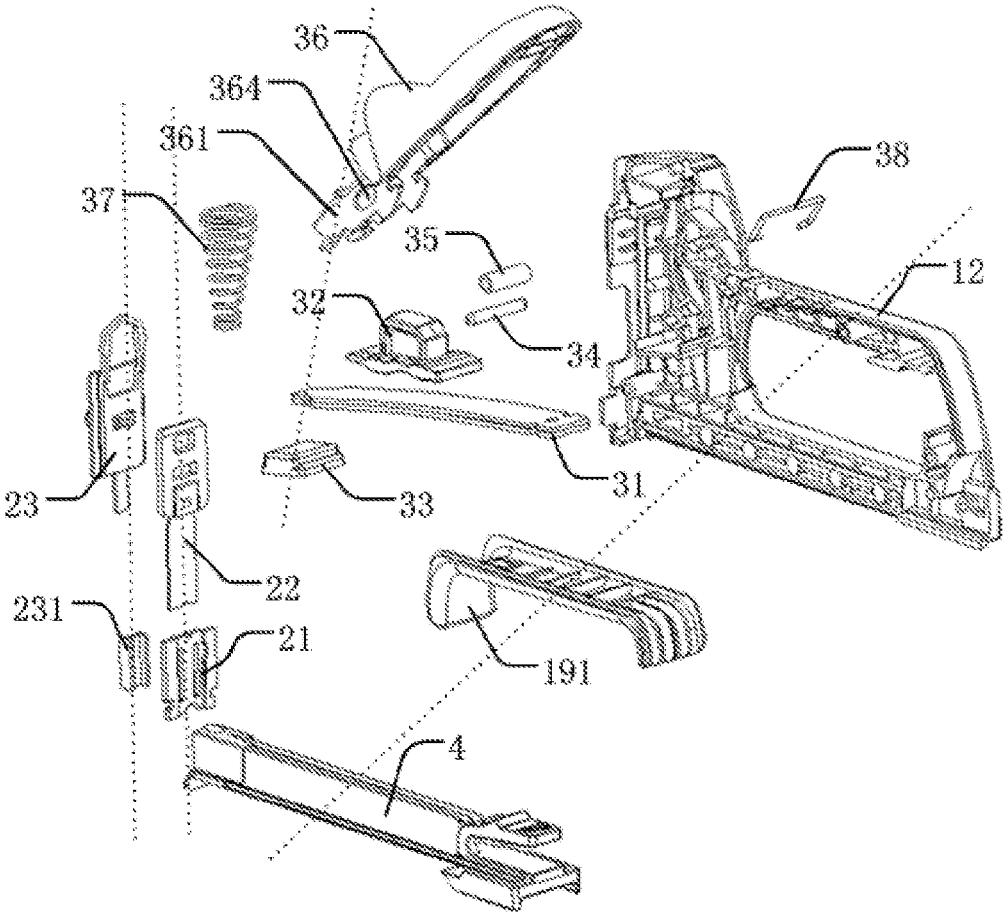
FIG. 9 is an exploded structural schematic diagram of some of the members according to the embodiment of the present invention.

As shown in FIGS. 4, 8 and 10, the first push button 233 passes through the first through hole 13 of the housing 1, a part of which protrudes outside the housing 1, and another part of which is connected to the second adjusting member 232. When the first button 233 is toggled up and down, the second adjusting member 232 slides up and down inside the second slide groove 17. One end of the press plate 234 is fixedly connected to the first push button 233 and/or the second adjusting member 232, and the other end thereof is inserted into the stepped groove 2313, and is tangent to the bottom surface of the stepped groove 2313. When the first push button 233 is toggled up and down, the press plate 234 slides up and down in the second slide groove 17.

As shown in FIGS. 3, 10, and 11, the first through hole 13 of the housing 1 includes a first position 131 and a second position 132. The first push button 233 is used for adjusting the depth of the staple feeding groove 211, such that the staple feeding groove 211 may receive staples of different thicknesses. When the first push button 233 is toggled, the press plate 234 moves simultaneously with the second adjusting member 232.

Figure 12:
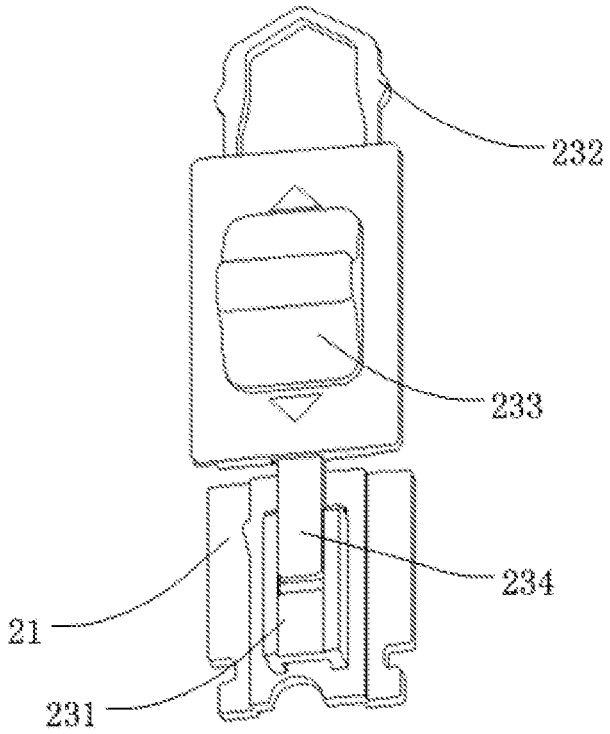
FIG. 12 is a structural schematic diagram of the nailing portion according to the embodiment of the present invention when the first push button is located at the first position.
Figure 13:
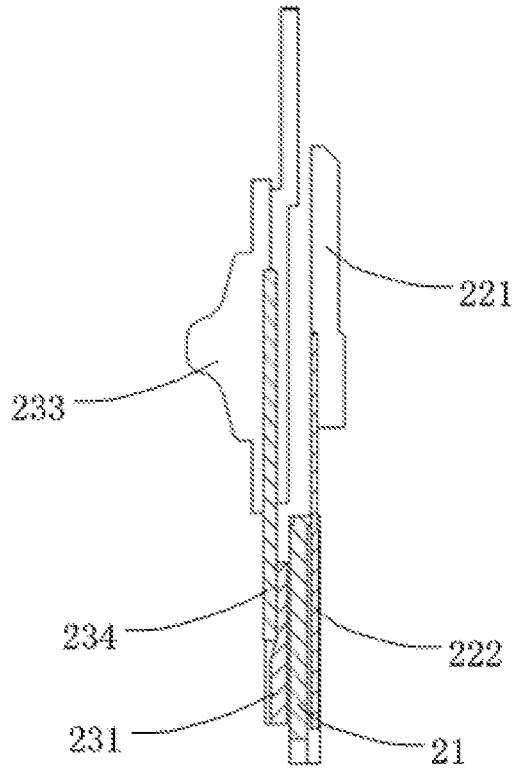
FIG. 13 is a sectional schematic diagram of the nailing portion according to the embodiment of the present invention when the first push button is located at the first position.

When the multifunctional stapler according to the present embodiment needs to be loaded with staples with a relatively large width, the first push button 233 needs to be switched to the first position 131. As shown in FIGS. 3, 12, 13, when the first push button 233 is located at the first position 131, the press plate 234 is tangent to the first stepped surface 2314; the distance of the front end of the lug of the adjusting member 2312 inserted into the fourth through hole 212 of the staple feeding member 21 is less than or equal to the depth of the fourth through hole 212 of the staple feeding member 21; in other words, the lug of the adjusting member 2312 would not protrude from the surface. The depth of the staple feeding groove 211 is kept to the maximal extent, and the staples with a relatively large width can be received, such that the staples are fixed well in a horizontal direction shown in the drawing.

Figure 14:
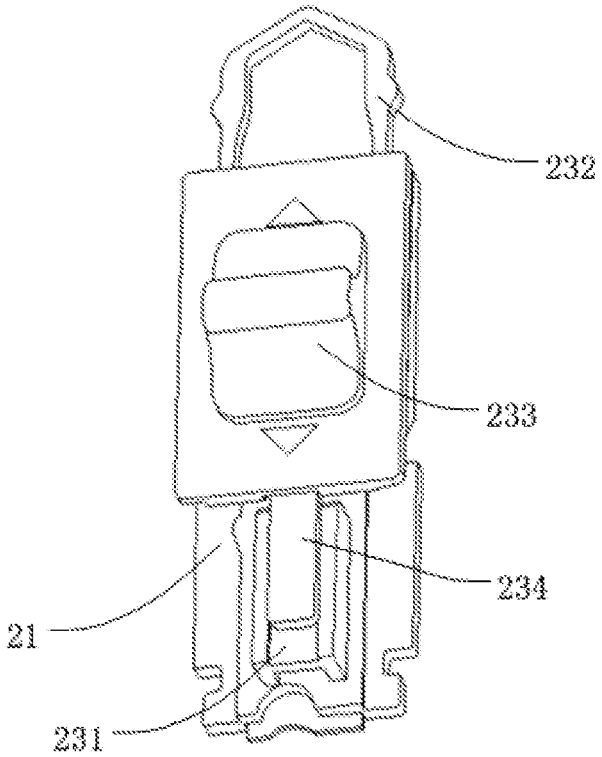
FIG. 14 is a structural schematic diagram of the nailing portion according to the embodiment of the present invention when the first push button is located at the second position.
Figure 15:
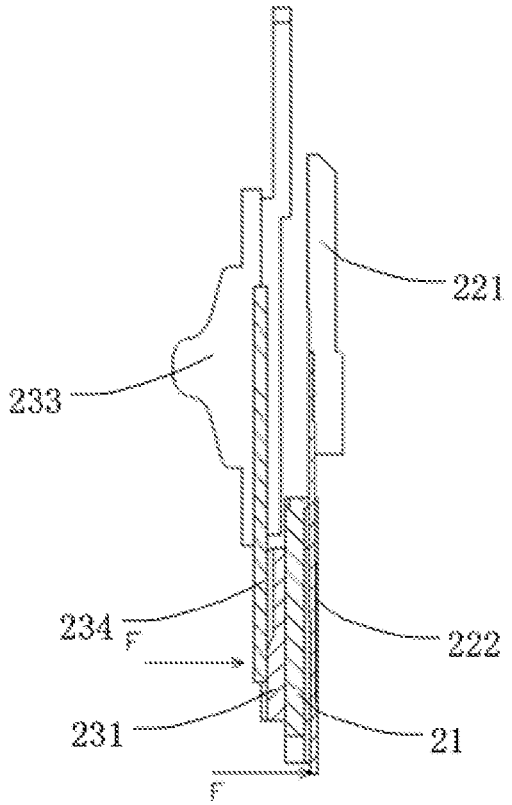
FIG. 15 is a sectional schematic diagram of the nailing portion according to the embodiment of the present invention when the first push button is located at the second position.

When the staples with a relatively small width need to be loaded in the multifunctional stapler according to the present embodiment, the first push button 233 needs to be switched to the second position 132. As shown in FIGS. 3, 14 and 15, when the first push button 233 is located at the second position 132, the press plate 234 is tangent to the second stepped surface 2315, thus forming a force F for pressing against the first adjusting member 231 in the horizontal direction. One side of the first adjusting member 231 is pressed against by the press plate 234, the lug of the adjusting member 2312 at the other side thereof moves deeply inside the fourth through hole 212 of the staple feeding member 21, such that the first adjusting member body 2311 is tangent to the surface of the staple feeding member 21. Simultaneously, the front end surface of the lug of the adjusting member 2312 protrudes from the bottom surface of the staple feeding groove 211, such that the receiving depth of the staple feeding groove 211 is decreased, so as to receive the staples with relatively small widths, so that the staples are fixed well in a horizontal direction shown in the drawings. If the first push button 233 is still held at the first position 131 at this time, since the depth of the staple feeding groove 211 is greater than the width of the staple, two or three staples may be placed in the staple feeding groove 211. When the striking member 22 strikes the staple, the striking plate 222 may strike the upper ends of two or three staples simultaneously, which seriously influences the staple striking effect, and leads to the fact that the staple cannot be struck.

During the position adjustment of the first push button 233 between the first position 131 and the second position 132, when the first push button 233 is toggled from the first position 131 to the second position 132, or when the first push button 233 is toggled from the second position 132 to the first position 131, the press plate 234 slides along the smooth inclined surface 2316, thereby switching the first push button 233 between the first position 131 and the second position 132.

As shown in FIGS. 5-9, the toggling device 3 includes a resilient plate 31, a second push button 32 and an elastic gasket 33. One end of the resilient plate 31 is fixed to the housing 1, and the other end thereof is inserted into the sixth through hole 2213 of the driven plate 221; the second push button 32 passes through the second through hole 14 of the housing 1, a part of which protrudes outside the housing 1, and another part of which is tangent to one side surface of the resilient plate 31; a part of the elastic gasket 33 is fixed to the housing 1, and another part thereof is tangent to another side surface of the resilient plate 31.

The toggling device 3 further includes a first axle 34, a second axle 35, a toggling member 36 and a first elastic member 37. The two ends of the first axle 34 are connected to the inner side walls of the two housing plates 11, 12 respectively; the two ends of the second axle 35 are connected to the inner side walls of the two housing plates 11, 12 respectively, and the second axle 35 is parallel with the first axle 34. The toggling member 36 rotates around the first axle 34 and/or the second axle 35 after stressed.

The toggling member 36 includes a toggling member body 361, a protruding portion of the toggling member 362, a first fixture slot 363 of the toggling member 36 and a waist-type hole of the toggling member 364.

The protruding portion of the toggling member 362 is arranged at the front end of the toggling member body 361, and inserted into the fifth through hole 2212 of the driven plate 221, the front end of the protruding portion of the toggling member 362 is partially arc, and the distance thereof inserted into the fifth through hole 2212 of the driven plate 221 is relatively short.

The first fixture slot 363 is arranged in the middle of the bottom of the toggling member body 361, tangent to the surface of the first axle 34, the first axle 34 is a rotating fulcrum of the toggling member body 361; the waist-type hole of the toggling member 364 is arranged in the middle segment of the toggling member body 361, and sheaths the second axle 35, for assisting the protruding portion of the toggling member 362 to slide out from the fifth through hole 2212 of the driven plate 221. Meanwhile, the rotation range of the toggling member body 361 is limited to some extent.

The first elastic member 37 is a spiral spring, one end of which is connected to the inner wall at the top portion of the housing 1, and the other end of which is connected to the top of the toggling member body 361. The joint between the first elastic member 37 and the toggling member 36 is adjacent to the front end of the housing 1. When the toggling member 36 is rotated due to a force, the front end of the toggling member body 361 presses against the first elastic member 37, to make it deformed. When the force on the toggling member 36 disappears, the first elastic member 37 recovers, such that the toggling member body 361 is reset, and the protruding portion of the toggling member 362 slides into the fifth through hole 2212 of the driven plate 221 again.

In the present embodiment, a steel wire 38 is further included, and is arranged at the top of the housing 1 in a barbed shape, with two ends hinged to the outer side of the two housing plates 11, 12 respectively, for limiting the position of the toggling device 3. The toggling member 36 includes a second fixture slot 365 of the toggling member 36, arranged in the middle segment of the toggling member body 361. The second fixture slot 365 is a clamp hook-shaped groove, and the steel wire 38 is clamped to the second fixture slot 365, for limiting the rotation range of the toggling member body 361. After the toggling member body 361 is ensured to be reset, the protruding portion of the toggling member 362 slides into the fifth through hole 2212 of the driven plate 221.

In the multifunctional stapler according to the present embodiment, when in use, in the case that the toggling member 36 is toggled by a user, the protruding portion of the toggling member 362 can drive the striking member 22 to move upwards in the first slide groove 16, and the resilient plate 31 is deformed in the meanwhile. After the striking plate 222 is extracted from the staple feeding groove 211, the staples arranged in the staple containing portion 4 are pushed to the staple feeding groove 211 in the horizontal direction, to be fixed. After the striking member 22 moves by a certain distance, the second axle 35 slides in the waist-type hole 364, such that the protruding portion of the toggling member 362 slides out of the fifth through hole 2212 of the driven plate 221. Under the action of the resilient plate 31, the striking member 22 slides downwards along the first slide groove 16 rapidly, and the striking plate 222 at the lower end of the striking member 22 slides into the staple feeding groove 211, and rapidly strikes the upper end of the staple located in the staple feeding groove 211, to realize the staple striking effect. After striking, under the action of the resilient plate 31, the striking member 22 can be rapidly reset; under the action of the first elastic member 37, the protruding portion of the toggling member 362 slides into the fifth through hole 2212 of the driven plate 221. The elastic gasket 33 is made of an elastic material. The above-mentioned process functions to buffer an impact force of the resilient plate 31, to limit the travel of the resilient plate 31 and the striking member 22, and to prevent the striking plate 222 from sliding by an overlong distance in the staple feeding groove 211 and affecting the reset of the striking member 22.

Figure 6:
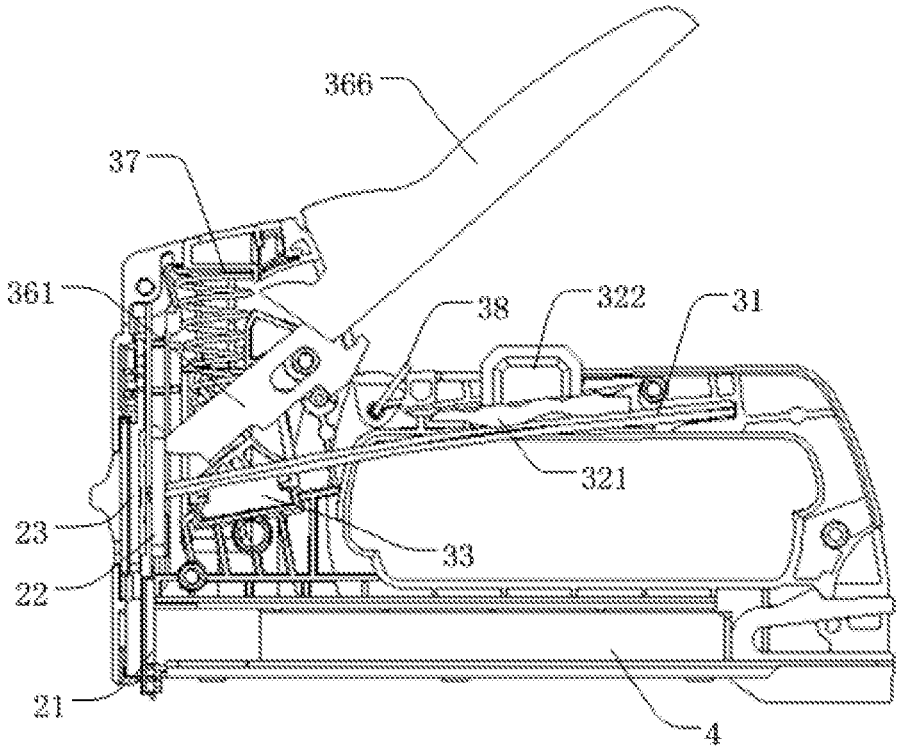
FIG. 6 is a structural schematic diagram with the first housing removed according to the embodiment of the present invention when viewed from another angle.
Figure 7:
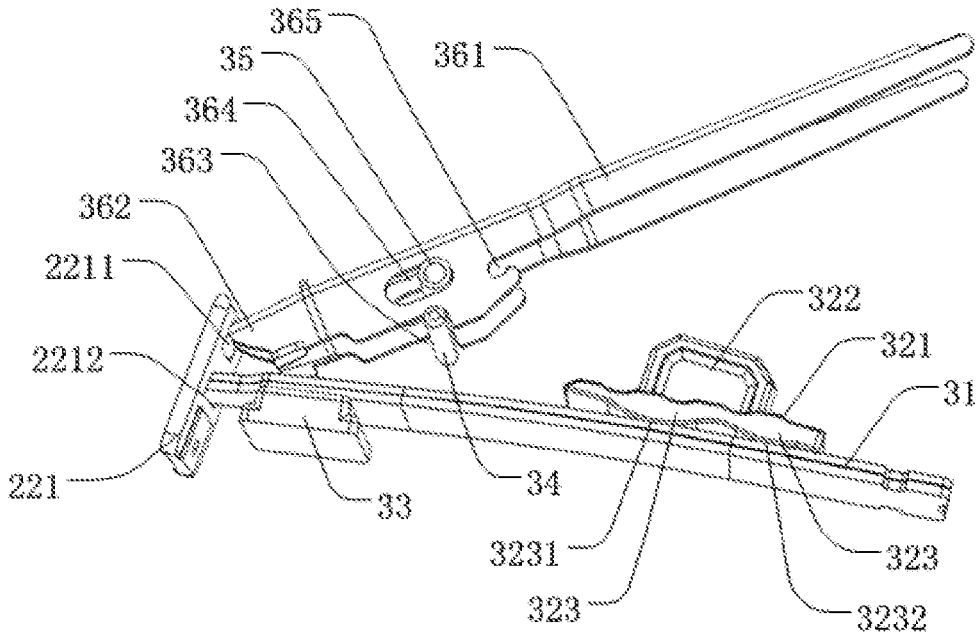
FIG. 7 is a structural schematic diagram of the toggling device and the striking member cooperating with each other according to the embodiment of the present invention.

As shown in FIGS. 6-7, the second push button 32 includes a toggle base 321 and a toggle block 322 which are connected with each other, and may also be integrated. Two arc protrusions 323 are arranged on the surface of the toggle base 321 towards one side of the resilient plate 31, and are tangent to one side surface of the resilient plate 31, to form two points of tangency 3231 and 3232. When the toggling member body 361 is toggled and rotated, the resilient plate 31 is deformed, and the point of tangency 3231 closer to the staple feeding groove 211 is a deformation fulcrum where the resilient plate 31 is deformed. The toggle block 322 is connected to the toggle base 321, and passes through the second through hole 14 of the housing 1, protruding outside the housing 1. The point of tangency between the second push button 32 (toggle base 321) and the resilient plate 31 is adjacent to the middle portion of the resilient plate 31; the point of tangency between the elastic gasket 33 and the resilient plate 31 is adjacent to the front end of the resilient plate 31.

As shown in FIG. 2, the second through hole 14 of the housing 1 includes a third position 141 and a fourth position 142; the second push button 32 is used for adjusting the strike force of the striking member 22. The user may select a suitable position as appropriated, to staple the objects to be stapled with different thicknesses.

If the user needs to use the multifunctional stapler according to the present embodiment to staple the object to be stapled with a relatively small thickness, it is necessary to adjust the second push button 32 to the third position 141. As shown in FIG. 7, when the second push button 32 is located at the third position 141, the distance of the deformation fulcrum 3231 from the striking member 22 is relatively large. The elastic force generated by the resilient plate 31 is relatively small, and the strike force of the striking plate 222 applied to the staple is relatively small.

If the user needs to use the multifunctional stapler according to the present embodiment to staple the object to be stapled with a relatively large thickness, it is necessary to adjust the second push button 32 to the fourth position 142. When the second push button 32 is located at the fourth position 142, the distance of the deformation fulcrum 3231 from the striking member 22 is relatively small. The elastic force generated by the resilient plate 31 is relatively large, and the strike force of the striking plate 222 applied to the staple is relatively large.

As shown in FIG. 1, a clamp hook 6 is arranged outside the housing 1, and is fixed to the surface of the housing 1, such that the multifunctional stapler according to the present embodiment is portable. As shown in FIGS. 2-3, the housing 1 includes a holding hole 19, penetrating through the middle portion of the housing 1. The holding hole gasket 191 is arranged on the two housing plates 11, 12 adjacent to the holding hole 19, for the user to hold conveniently. As shown in FIG. 6, the part of the toggling member body 361 located outside the housing 1 is covered with the handheld portion 366. The handheld portion 366 has a shape corresponding to that of the human hand, for convenient holding.

Figure 16:
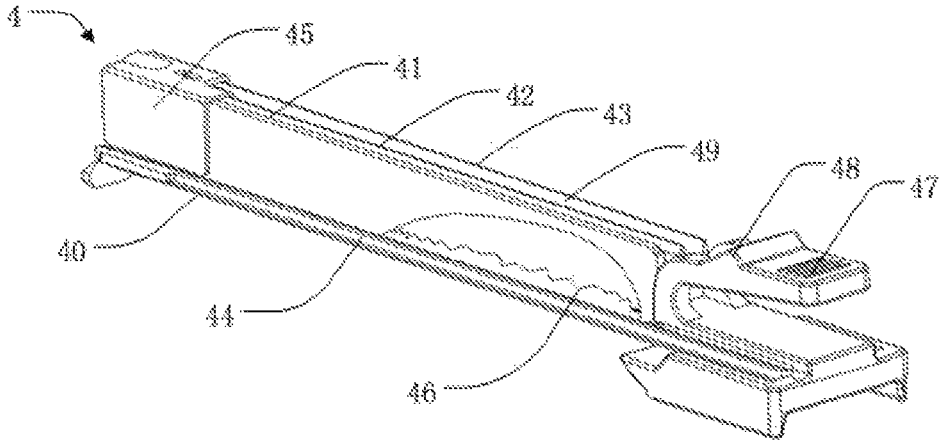
FIG. 16 is an overall structural schematic diagram of the staple containing portion according to the embodiment of the present invention when viewed from an angle.
Figure 17:
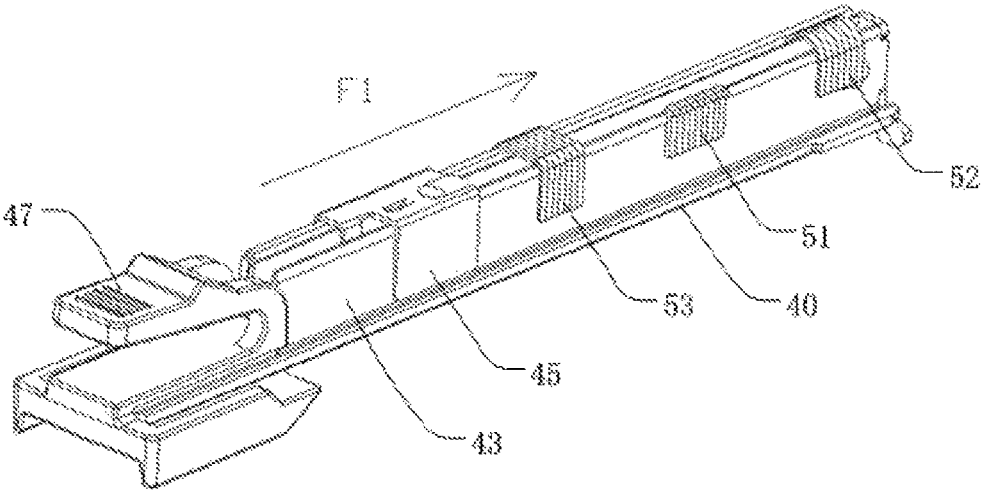
FIG. 17 is an overall structural schematic diagram of the staple containing portion according to the embodiment of the present invention when viewed from another angle.
Figure 18:
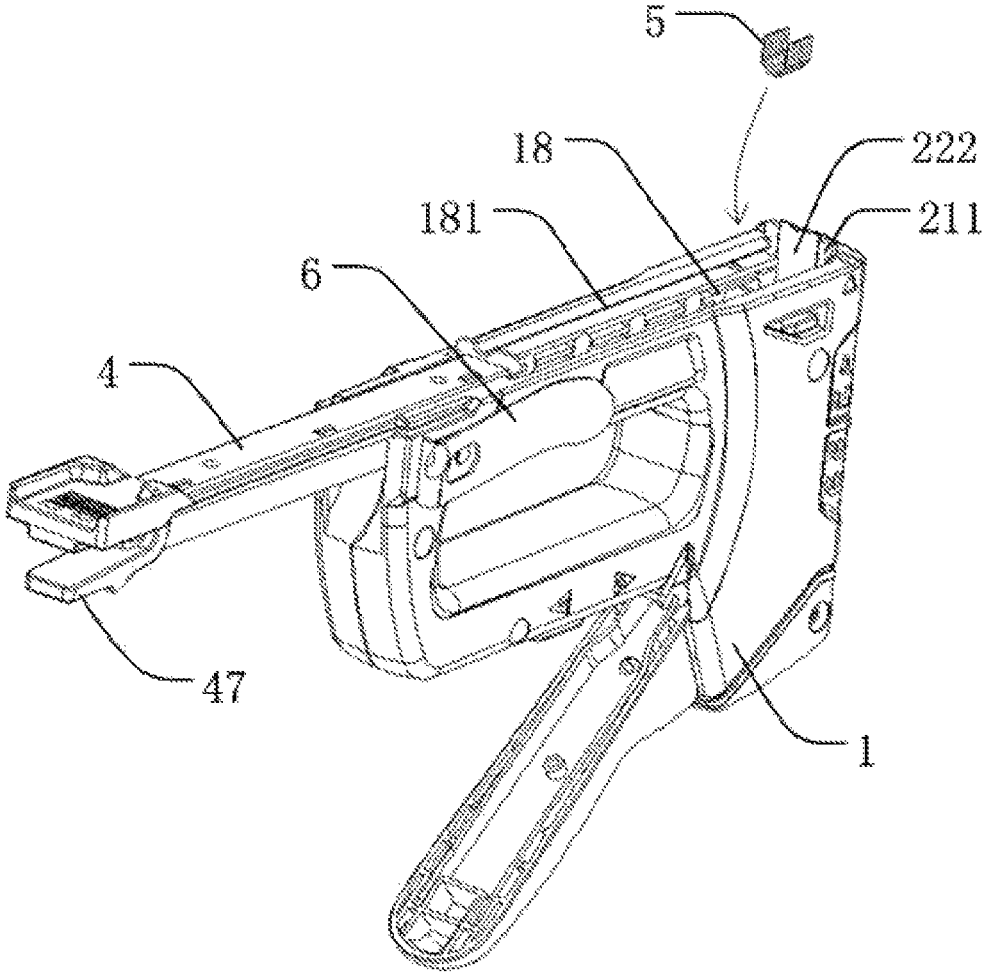
FIG. 18 is a schematic diagram of the state of the embodiment of the present invention during staple loading.

As shown in FIGS. 16-18, the staple containing portion 4 includes a base of the staple containing portion 40, a first rib 41, a second rib 42, a third rib 43 and a linear convex rib 44. The first rib 41, the second rib 42 and the third rib 43 are fixed to the top surface of the base of the staple containing portion 41, and are parallel with each other. A slit 49 is existed between the two adjacent ribs.

As shown in FIG. 17, for the staples according to the present embodiment, T-shaped staples, U-shaped staples, barbed staples or '-'shaped staples may be used, and may be placed over the rib. When the T-shaped staples 51 or the '-'-shaped staples are used, they may be mounted to the edge of any one rib, or in the slit 49 between the two adjacent ribs. When the U-shaped staples 52 or the barbed staples 53 are used, they may traverse across one or plural ribs. FIG. 17 is a schematic diagram of the staples of three specifications and three different shapes mounted in the staple containing portion 4, and the three staple groups are not installed simultaneously.

As shown in FIG. 10, the side wall of the staple feeding groove 211 is provided with a breach 213. As shown in FIG. 16, the edge on any one rib is chamfered. One relatively large end of the T-shaped staples 51 can be mounted into the breach 213 or hung at the chamfer, which is convenient for the location of the T-shaped staples 51 in the staple feeding groove 211.

As shown in FIGS. 3 and 18, the multifunctional stapler according to the present embodiment further includes a third slide groove 18 for the staple containing portion, arranged at the bottom of the housing 1; the staple containing portion 4 is slidably mounted to the third slide groove 18. Specifically, the two opposite inner side walls of the third slide groove 18 are provided with linear recesses 181 respectively. The number of linear convex ribs 44 is two, protruding from the outer surface of the two side walls of the base of the staple containing portion 41, and inserted into the linear recesses 181 respectively. The front ends of the ribs 41, 42 and 43 correspond to the staple feeding grooves 211. The linear recess 181 is matched with the linear convex rib 44, such that the staple containing portion 4 may slide freely in the third 18.

The staple containing portion 4 further includes a pushing block 45 and a second elastic member 46. The second elastic member 46 is preferably a spiral spring, one end of which is fixed to the pushing block 45, the other end of which is fixed to the rear end of the base of the staple containing portion 41. The second elastic member 46 may be mounted in the slit 49 between the two adjacent ribs. The pushing block 45 is slidably mounted to the ribs 41, 42 and 43; the pushing block 45 is driven by the elastic force of the second elastic member 46 to generate a forward pushing force F1.

The multifunctional stapler further includes a slot (not shown in the drawings), arranged at the bottom of the third slide groove 18. The staple containing portion 4 further includes an elastic key 47 and a clamping block 48 which are integrated. The elastic key 47 is arranged at the top of the rear end of the base of the staple containing portion 41; the clamping block 48 is arranged at the top of the rear end of the base of the staple containing portion 41, and clamped to the slot (not shown in the drawings).

As shown in FIGS. 17-18, in the present embodiment, during the staple loading, the elastic key 47 is pressed down, and the clamping block 48 is disengaged from the slot (not shown in the drawings), thereby making a part of the base of the staple containing portion 41 slide out from the third slide groove 18, and leaving the staple loading space between the front end of the staple containing portion 4 and the striking plate 222. The user may pull the pushing block 45, such that the second elastic member 46 is deformed; then the staple group 5 consisting of a plurality of staples arranged in parallel is mounted to the staple loading space, the staple containing portion 4 is put in the third slide groove 18, and the clamping block 48 is re-clamped in the slot (not shown in drawings), such that the staple containing portion 4 is fixed in the housing 1. Meanwhile, the pushing force F1 of the pushing block 45 is used to mount the staple group 5 between the pushing block 45 and the striking plate 222. The staple group 5 is arranged across the outside of at least one guide rail or in the slit between the two adjacent guide rails.

The staple at the most front end of the staple group is tangent to the striking plate 222 in the staple feeding groove 211 under the action of the pushing block 45. When the toggling member body 361 is rotated, the striking plate 222 is disengaged from the staple feeding groove 211, and the staple at the most front end of the staple group 5 is put in the staple feeding groove 211 under the action of the pushing force F1.

Before or after staple loading, the user may adjust the position of the first push button 233 according to a single width of the selected staple, so as to adjust the depth of the staple feeding groove 211, and adjust the position of the second push button 32 according to the thickness of the object to be stapled, so as to adjust the strike force of the striking member 22.

The present embodiment has the advantages that a multifunctional stapler is provided, capable of adjusting a depth of the staple feeding groove, such that the staples with different widths may be stably positioned in the staple feeding groove, thus being struck out, so as to realize stapling effects. The present invention may further adjust the strike force according to the thickness of the object to be stapled, thereby realizing better striking effects. The multifunctional stapler according to the present invention has a simple structure, a relatively low production cost, convenient operations, and a wide application range, can be used for striking staples of various specifications and shapes, such as T-shaped staples, '-'-shaped staples, U-shaped staples, or barbed staples with different widths and specifications.

The invention has been exemplified above with reference to specific embodiments. It should be understood that a multitude of modifications and variations can be made by a common person skilled in the art without departing from the conception of the present invention, and those modifications and variations shall be deemed within the protection scope of the invention.

The invention claimed is:

1. A multifunctional stapler, comprising:

a housing;

a nailing portion arranged at a front end of the housing; and a toggling device, a part of which being arranged inside the housing, and a part of which extending outside of the housing;

the nailing portion comprises:

a staple feeding member arranged at a front end of a bottom of the housing;

a staple feeding groove arranged on a surface at one side of the staple feeding member, for receiving staples;

a striking member, a part of which being inserted into the staple feeding groove, the toggling device controlling the striking member to strike the staples; and an adjusting device, a part of which being arranged outside the housing, for adjusting a depth of the staple feeding groove;

wherein the housing comprises:

a first through hole penetrating through a front wall of the housing;

a second through hole penetrating through a top wall of the housing;

a third through hole penetrating through a side wall at an upper part of the housing;

a first slide groove for receiving the striking member which is slidable inside the first slide groove; and a second slide groove;

wherein the staple feeding member further comprises:

a fourth through hole, penetrating through a wall of the staple feeding groove;

the adjusting device comprises:

a first adjusting member, at one side of which a lug of the first adjusting member being provided and inserted into the fourth through hole of the staple feeding member, at another side of which a stepped groove being provided;

a second adjusting member sliding in the second slide groove of the housing;

a first push button, penetrating through the first through hole of the housing, a part of which protruding outside the housing, another part of which being connected to the second adjusting member; and a press plate, one end of which being connected to the first push button and/or the second adjusting member, the other end of which being inserted into the stepped groove, and contacting with a bottom surface of the stepped groove;

wherein the bottom surface of the stepped groove comprises:

a first stepped surface;

a second stepped surface; and an inclined surface connecting the first stepped surface with the second stepped surface.

2. The multifunctional stapler according to claim 1, wherein the first through hole of the housing comprises a first position and a second position;

when the first push button is located at the first position, the press plate is contacting with the first stepped surface and a distance of a front end of the lug of the first adjusting member inserted into the third through hole of the staple feeding member is less than or equal to a depth of the third through hole of the staple feeding member;

when the first push button is located at the second position, the press plate is contacting with the second stepped surface and the front end of the lug of the first adjusting member protrudes from the wall of the staple feeding groove.

3. The multifunctional stapler according to claim 1, wherein the striking member comprises:

a driven plate; and a striking plate, one end of which being fixed to the driven plate, the other end of which being inserted into the staple feeding groove.

4. The multifunctional stapler according to claim 3, wherein the driven plate comprises:

a first body;

a fifth through hole, penetrating through the first body; and a sixth through hole, penetrating through the first body of the driven plate.

5. The multifunctional stapler according to claim 4, wherein the toggling device comprises:

a resilient plate, one end of which being fixed to the housing, and the other end of which being inserted into the sixth through hole of the driven plate;

a second push button, passing through the second through hole of the housing, one part of which protruding outside the housing, and another part of which contacting with one side surface of the resilient plate; and an elastic gasket fixed to the housing and contacting with another side surface of the resilient plate.

6. The multifunctional stapler according to claim 5, wherein the second through hole of the housing comprises a third position and a fourth position;

among at least one contacting point between the second push button and the resilient plate, one point of contact closest to the striking member is a fulcrum for a deformation of the resilient plate;

a distance between the fulcrum and the striking member when the second push button is located at the third position is greater than the distance between the fulcrum and the striking member when the second push button is located at the fourth position.

7. The multifunctional stapler according to claim 5, wherein the second push button comprises:

a toggle base, at least one arc protrusion is arranged on a surface of the toggle base facing towards the resilient plate and contacting with the one side surface of the resilient plate; and a toggle block connected to the toggle base and passing through the second through hole of the housing, protruding outside the housing.

8. The multifunctional stapler according to claim 5, wherein a contacting point between the second push button and the resilient plate is adjacent to a middle part of the resilient plate;

a contacting point between the elastic gasket and the resilient plate is adjacent to the other end of the resilient plate that is inserted into the sixth through hole of the driven plate.

9. The multifunctional stapler according to claim 1, wherein the toggling device comprises:

a first axle, two ends of which being perpendicularly connected to an inner side of two opposite side walls of the housing respectively;

a second axle, two ends of which being perpendicularly connected to the inner side of the two opposite side walls of the housing, the second axle being parallel to the first axle;

a toggling member, which rotates around the first axle and/or the second axle after being stressed;

a first elastic member, one end of which being connected to the housing, the other end of which being connected to a top of the toggling member; a joint between the first elastic member and the toggling member being adjacent to the front end of the housing.

10. The multifunctional stapler according to claim 9, wherein the toggling member comprises:

a second body;

a protruding portion of the toggling member arranged at a front end of the second body and inserted into a fifth through hole of a driven plate;

a first fixture slot of the toggling member arranged at a bottom of the second body and tangent to a surface of the first axle; and a hole of the toggling member arranged in a middle of the second body and provided around an outside of the second axle.

11. The multifunctional stapler according to claim 10, wherein the toggling member further comprises a second fixture slot arranged in the middle of the second body of the toggling member;

the multifunctional stapler further comprises a barbed steel wire arranged cross a top of the housing, two ends of which being hinged to an outer side of two housing plates of the housing respectively; the steel wire being clamped to the second fixture slot of the toggling member.

12. The multifunctional stapler according to claim 1, further comprising:

a third slide groove arranged at the bottom of the housing, one end of which corresponding to the staple feeding groove; and a staple containing portion slidably mounted to the third slide groove, for putting and fixing the staples in and to the staple feeding groove.

13. The multifunctional stapler according to claim 12, wherein two opposite inner side walls of the third slide groove are provided with linear recesses respectively;

the staple containing portion comprising:

a base of the staple containing portion;

two or more parallel first ribs fixed to a top surface of the base of the staple containing portion; a front end of the first ribs being arranged opposite to a notch of the staple feeding groove; and a linear convex rib protruding from an outer surface of two side walls of the base of the staple containing portion and inserted into the linear recesses.

14. The multifunctional stapler according to claim 13, wherein the staple containing portion further comprises:

a pushing block slidably mounted to an outside of the first ribs; and a second elastic member, one end of which being fixed to the pushing block, and the other end of which being fixed to a rear end of the base of the staple containing portion.

15. The multifunctional stapler according to claim 14, further comprising a slot arranged at a bottom of the third slide groove;

the staple containing portion further comprises:

an elastic key arranged at a top portion of a rear end of the base of the staple containing portion;

a fixture block arranged at the top portion of the rear end of the base of the staple containing portion and clamped to the slot;

when the elastic key is pressed down, the fixture block is disengaged from the slot.

16. The multifunctional stapler according to claim 1, wherein the housing comprises:

a holding hole penetrating through a middle portion of the housing; and/or a clamp hook fixed to a surface of the housing;

wherein the staples used in the stapler are T-shaped staples, U-shaped staples, barbed staples or '-'-shaped staples.

* * * * *